United States Patent [19]

Hays

[11] 4,350,408

[45] Sep. 21, 1982

[54] ELECTRICAL PIN CONNECTOR

[76] Inventor: Bill J. Hays, 10582 Palladium Ave., Garden Grove, Calif. 92640

[21] Appl. No.: 171,535

[22] Filed: Jul. 23, 1980

[51] Int. Cl.[3] ..... H01R 13/46

[52] U.S. Cl. ..... 339/149 S; 339/213 S; 339/217 SP; 339/150 R

[58] Field of Search ..... 339/217 SP, 218 S, 220 A, 339/223 S, 213 S, 136 C, 140 S, 143 S, 149 S, 150 R, 263 S, 255 B, 252 R, 26; 200/19 DC; 123/146.5 R

[56] References Cited

U.S. PATENT DOCUMENTS

| | | | |
|---|---|---|---|
| 2,678,428 | 5/1954 | Fiet | 339/256 RT X |
| 2,745,075 | 5/1956 | Simpkins et al. | 339/218 S |
| 3,076,113 | 1/1963 | Candelise | 339/26 X |
| 3,354,419 | 11/1967 | Miller, Jr. | 339/26 |
| 3,632,965 | 1/1972 | Guth | 200/19 DC |
| 4,023,546 | 5/1977 | Kawakami | 200/19 DC X |

*Primary Examiner*—John McQuade
*Assistant Examiner*—John S. Brown
*Attorney, Agent, or Firm*—Fischer, Tachner & Strauss

[57] ABSTRACT

There is disclosed a pin connector particularly suited for use in automotive ignition wiring. The pin connector comprises a metal shaft for insertion into the standard wire receiving sleeves of distributors, coils and the like and, for this purpose has a metal shaft with a diameter less than that of the sleeve to be received loosely therein with a groove intermediate its length to oppose the annular slot of the receiving sleeve and a resilient retainer seated in this groove and resiliently projecting into the slot to retain the pin connector in the sleeve. The pin connector has a prong connector end having a bulbous end with a reduced diameter neck to receive a box connector that has a mating socket with a detent to be received over the prong connector and to complete the connection to an ignition wire. The pin connector is sized of lesser diameter than the internal diameter of the receiving sleeve to provide a tolerance therebetween, accommodating manufacturing imprecisions. The pin connector is used in combination with an elastic boot carried on the conductor which is slipped over the pin connector and the supporting structure of the housing or the receiving sleeve so that the pin connector is resiliently biased in the assembly, in secure electrical contact with the receiving sleeve.

6 Claims, 3 Drawing Figures

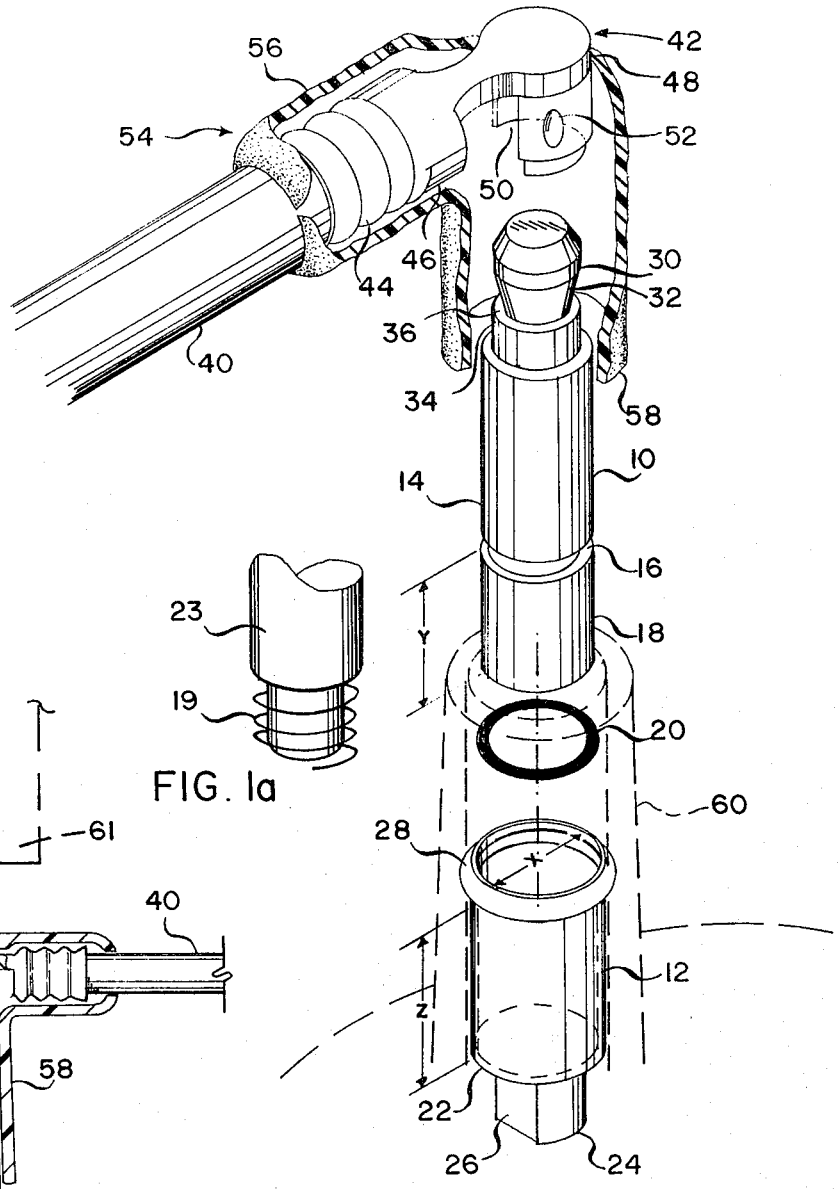
FIG. 1a
FIG. 1
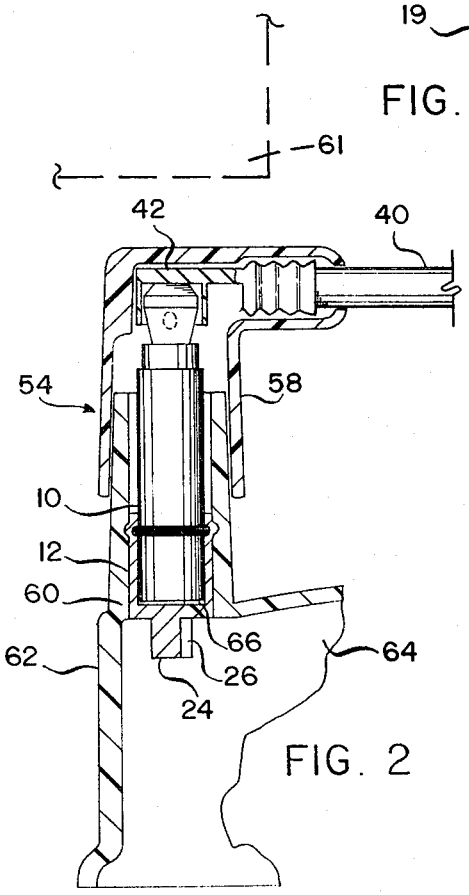
FIG. 2

ELECTRICAL PIN CONNECTOR

BACKGROUND OF THE INVENTION

The typical ignition wiring in internal combustion engines includes a distributor cap and coil and spark plugs interconnected by electrical conductors having box connectors to secure to the spark plugs and metal wrapped ends which are inserted into sleeve connectors contained within tubular housings of the coil and distributor. The connections of the metal wrapped ends to the receiving sleeves of the coil and distributor are subject to failure from corrosion and vibration which can interrupt the electrical continuity. The electrical connections are often made in very close quarters with limited vertical clearances for other connectors, further limiting the design of any connectors for this application.

An attempt has been made to improve the electrical connection by a metal shaft having a threaded terminal end received in an internally threaded insulator bonnet carried by the end of the ignition wire. This connector found only limited use and it is believed has been withdrawn from the market.

BRIEF DESCRIPTION OF THE INVENTION

This invention comprises a connector which can be inserted and secured within the receiving sleeve that is customarily used in the electrical ignition equipment of an internal combustion engine, such as the receiving sleeves present on most distributor caps and coils of ignition systems for such engines. The receiving sleeve is of standardized construction for most engines and is approximately 7 millimeters in diameter having an annular slot intermediate its length. The pin connector of the invention has a diameter less than the receiving sleeve to be received loosely therein with a groove in the shaft intermediate its length opposing the annular slot of the sleeve and a resillient retainer seated in the groove and projecting into the slot to retain the assembly. The opposite end of the pin connector has a prong connector end with a bulbous terminal having a reduced diameter neck to be received in a standard box connector such as those used for attachment to the electrical terminal of spark plugs. The pin connector is used in the assembly by inserting it into the receiving sleeve, snapping it therein with the resilient retainer received in the annular slot of the sleeve. Although the pin connector is loosely received in this sleeve, a tight attachment is achieved by placement of the box connector attached to an electrical lead such as an ignition wire over the prong connector end of the pin connector and placing an elastomeric cover over the exposed connector end with an elastic sleeve that resiliently receives the tubular housing surrounding the sleeve and biases the connector into a firm electrical contact with the receiving sleeve.

BRIEF DESCRIPTION OF THE DRAWINGS

The invention will be described with reference to the figures of which:

FIG. 1 is an exploded isometric view of the thin connector and interconnecting elements of the invention; and, FIG. 2 is an elevation cross-sectional view of a portion of a distributor cap showing the connector assembly.

DESCRIPTION OF PREFERRED EMBODIMENTS

Referring now to FIG. 1, the pin connector 10 of the invention is shown in an exploded view, extracted from the receiving sleeve 12. The pin connector 10 has a straight shaft portion 14 with an annular groove 16 intermediate the length of the shaft portion, providing an unrelieved end portion 18. Annular groove 16 receives a resilient retainer such as an elastic O-ring 20 which has a thickness, compared to the depth of annular groove 16 that is sufficient to project past the outer cylindrical surface of shaft 14.

The receiving sleeve, which is substantially standard in all automotive systems, comprises a cylindrical sleeve 22 with a lower dependent shank 24. This shank 24, when employed in a distributor has a flat land 26 that faces radially inwardly of the distributor cap to provide an electrical contact surface opposing the electrical contact surface of the rotor of a distributor. The sleeve 22 has an annular slot 28 which is rolled into the metal wall of the sleeve 22 and which receives O-ring 20 when the pin connector 10 is inserted into sleeve 22.

The diameter X of the sleeve 22 is a standard dimension for substantially all electrical systems and is from 0.323 to 0.325 inch. The diameter of shaft 14 of pin connector 10 is slightly less, typically about 0.3125 inch to provide a tolerance of from 0.01 to 0.021 inch, thus insuring a loose fit of the pin connector 10 within receiving sleeve 22. The length of the straight shaft portion 18 beneath annular groove 16, Y, is also sized from 0.002 to about 0.012 inch less than the inside height of sleeve 22 below annular slot 28, Z, to permit the facile insertion of the pin connector into sleeve 22 and to permit snapping of the pin connector into place, seating O-Ring 20 in the annular slot 28 of the receiving sleeve.

The opposite or free end of pin connector 10 has a bulbous portion 30 with a tapered section 32 to a reduced diameter neck 34, providing an annular shoulder 36 there between. The size and configuration of this prong connector end of the pin connector 10 simulates the size and shape of the conductor terminal of a spark plug, thereby permitting use of a conventional spark plug box connector.

The ignition wire 40 distally bears a box connector generally designated at 42. The latter has channel portion 44 which is received over the end 46 of the ignition wire 40 and is crimped thereto. The opposite end of the box connector 42 is of a cylindrical cup shape with a cylindrical wall 48 having an open section 50 and hemispherical indents 52 on its opposite side walls to serve as detents for securing the box connector to the prong end of the pin connector 10.

The entire assembly is contained within an electrical connector boot 54 having a tubular portion 56 which is received about the end of the ignition wire 40 and a enlarged diameter sleeve portion 58 which fits over the pin connector 10 and the tubular housing 60 which is shown in the phathom lines of FIG. 1. The elastic boot 54 resiliently biases the connector 10 in the assembly so that the connector firmly contacts the metal sleeve at one or more locations. In a preferred embodiment which is shown in FIG. 1*a*, a helical coil spring 19 is placed in the sleeve 12 to insure electrical contact between these elements, avoiding static radio interference. If desired, the end 21 of shank 18 of pin 10 can have a reduced diameter shank 23 to seat spring 19.

Referring now to FIG. 2, the invention is shown in its assembled state with the pin connector 10 seated in sleeve 12 within the tubular extension 60 of a distributor cap 62. The connector assembly has a low profile to fit within stock clearances beneath stock structures such as air cleaner 61. These clearances are often less than 1 inch and can be as slight as ½ inch in some cars. The shank 24 of the sleeve 12 projects into the cavity 64 of the distributor with the flat land 26 facing radially inwardly to the center of the distributor cap 62. The pin connector thus installed is supported by a slight gap 66 above the inside bottom wall of the sleeve connector 12 and loosely fits within the sleeve. The pin connector 10, however, is maintained in secure electrical continuity with the sleeve 12 by the elastic force exerted on the assembly by the electrical connector boot 54. The latter is formed of a resilient elastomer, e.g. rubber polyurethane, etc. and has an enlarged diameter sleeve portion 58 which is resiliently received over the upper end of tubular housing 60. The opposite end of the resilient boot 54 receives the ignition wire 40 and the box connector 42 which is crimped to the wire 40 and which receives the prong connector end of the pin connector 10.

The pin connectors of the invention provide significant advantages over the prior electrical connections employed in automotive electrical systems. The pin connectors permit universal application of the standard receiving sleeve connectors 12 to any of a wide variety of ignition wire. Commonly, the sleeve connectors have a diameter of approximately 7 mm. and, accordingly, only readily accept ignition wires of this diameter. The pin connectors of the invention, however, can accept any size diameter ignition wire such as the more preferable 8 and 9 mm. diameter wire, since the box connector 42 can readily be selected for varied diameter wire. The pin connectors are sized of a sufficiently lesser diameter than the internal diameter of the receiving sleeves 12 so that the assembly will accommodate imprecisions in manufacturing sleeves 12 as well as in mounting of these sleeves in their tubular housings such as 60 where it is not uncommon to encounter sleeves which are substantially off center or inclined in the assembly. The pin connectors can be simply snapped into place seating and locking automatically and are readily removable for servicing of the electrical system. Furthermore, when the pin connectors are retained with a resilient O-Ring, such as preferred, the O-Ring effectively seals the assembly against moisture and prevents corrosion. This sealing can be further enhanced by coating of the pin connector with a suitable electrical conducting silicon grease. The seal against moisture invasion is further enhanced by the elastomer boot 54 which fits snuggly about the tubular extension 60 of the housing for the receiving sleeve.

The pin connectors are universally adaptable to nearly all ignition systems which are presently on the market. They permit the use of large diameter wire, e.g., 8 or 9 millimeter wire rather than standard 7 millimeter wire for improved ignition. The pin connectors can readily be inserted into the distributor caps and into the high voltage terminal of the ignition coils used on automotive engines and provide a very low profile interconnection particularly when employed with the right angle boot such as 42 shown in the preferred embodiment.

Although the invention has been illustrated with use of an elastic O-Ring retainer, other equivalent structures can, of course, be applied, such as retaining clips formed of steel, Nylon and the like.

The invention has been described with reference to the illustrated and presently preferred embodiment. It is not intended that the invention be unduly limited by this description of the preferred embodiment. Instead, it is intended that the invention be defined by the means, and their obvious equivalents, set forth in the following claims:

What is claimed is:

1. The improved electrical assembly comprising:

an automotive electrical means having a standard wire receiving sleeve with an annular slot therein; and a pin connector for securing an ignition wire within said sleeve and having:

a metal shaft having a diameter less than said sleeve to be received loosely therein;

a groove in said shaft intermediate its length to oppose said annular slot of said sleeve;

a resilient retainer seated in said groove and resiliently projecting into said slot; and a prong connector end having a bulbous end with a reduced diameter neck.

2. The assembly of claim 1 wherein said electrical means is an automotive distributor having at least one said wire receiving sleeve and the pin connector received in said wire receiving sleeve and interlocked therein by said resilient retainer.

3. The assembly of claim 2 including an electrical conductor cord distally carrying a box connector having a socket with detent means received over said prong connector end of said pin connector.

4. The assembly of claim 1 wherein said receiving sleeve is supported in an electrical means housing having a tubular extension projecting past said sleeve.

5. The assembly of claim 4 including an electrical conductor cord distally carrying a box connector having a socket with detent means received over said prong connector end of said pin connector and an elastic flexible sleeve distally carried on aid cord, surrounding said box connector and projecting therefrom to resiliently seat about said tubular extension of said housing.

6. The assembly of claim 5 wherein said housing is a distributor cap for an internal combustion engine having a plurality of said tubular extensions and receiving sleeves, each receiving a respective pin connector attached to an ignition conductor.

* * * * *